US006098745A

United States Patent [19]

Zalben

[11] Patent Number: 6,098,745

[45] Date of Patent: Aug. 8, 2000

[54] DOME MUFFLER

[76] Inventor: Jonathan Zalben, 70 South Rd., Port Washington, N.Y. 11050

[21] Appl. No.: 09/253,257

[22] Filed: Feb. 19, 1999

[51] Int. Cl.[7] ..... F01N 7/18

[52] U.S. Cl. ..... 181/282; 181/265; 181/272

[58] Field of Search ..... 181/255, 264, 181/265, 267, 269, 270, 272, 282

[56] References Cited

U.S. PATENT DOCUMENTS 4,153,136 5/1979 Ferralli ..... 181/252

5,962,822 10/1999 May ..... 181/264

*Primary Examiner*—Khanh Dang

[57] ABSTRACT

A muffler including paraboloid steel baffle chambers which may contain a continuously encased vacuum. These chambers can be shaped out of steel paraboloids. The exhaust of the engine (or noise source) can flow into the space between chambers and out of the muffler with high efficiency. The paraboloids are designed so that the noise is reflected to maximize a sound wave's path and minimize its intensity.

14 Claims, 3 Drawing Sheets

DOME MUFFLER

FIELD OF THE INVENTION

The present invention relates generally to the field of noise reduction, and more particularly to parabolic shaped dome mufflers with vacuum chambers.

BACKGROUND OF THE INVENTION

Noise reduction devices such as mufflers are well known. The following patents are exemplary of existing technology for the reduction of sound emitted by portable and large scale devices.

U.S. Pat. No. 5,214,254 to Russell T. Sheehan discloses a triple cone exhaust wave tuner which alters the resonant frequency of waves generated in the baffle chambers. However, it does not provide for attenuation.

U.S. Pat. No. 5,611,409 to Michael Arseneau discloses an exhaust muffler for small internal combustion engines. However, it is not applicable to large-scale machines with combustion engines.

U.S. Pat. No. 5,739,485 to Vincent Cholet et. al. discloses a three casing muffler for motor vehicles which attenuates high frequency exhaust noise. However, the muffler does not attenuate lower frequency sounds, which are more likely to be bothersome over a greater distance.

U.S. Pat. No. 4,046,219 to Nisar Shaikh discloses a muffler which attenuates high frequency exhaust noise from internal combustion engines, but does not account for low frequency noise.

Other methods of noise reduction include noise cancellation (i.e. the use of destructive interference to "cancel" a mechanical noise with artificially produced noise), the use of padding and insulation (using rubber, cellulose, and fiberglass), and the use of baffle plates for cars, airplanes, vacuum cleaners, lawn mowers, leaf blowers, snowblowers, and other portable devices.

The need exists for a muffler that more efficiently reduces the risk of hearing impairment and general discomfort. It is thus an object of the present invention to provide increased attenuation of engine noise through the use of a vacuum for sound encasement. It is another object to provide the chambers in a parabolic shape such that the reflection path is increased. It is still another object of the invention to provide a muffler which may be employed by different sized engines and motors.

These and other objects of the invention will become apparent to those skilled in the art from the following description.

SUMMARY OF THE INVENTION

The foregoing objects, among others, are attained by the invention, which in one aspect provides a method of attenuating sound propagating from a noise source. The method includes propagating the sound through a parabolic dome shaped muffler which has an entrance and an exit. The muffler also has at least one path from the entrance to the exit. The sound is provided through the entrance and leaves through the exit. A barrier is provided in the path of the sound within the muffler between the entrance and the exit which reflects the sound to propagate it in a direction of at least one of the paths.

Another embodiment of the invention provides a muffler having multiple concentric parabolic dome shaped barriers. The barriers form chambers at least one of which may be filled with a vacuum.

The invention will next be described in connection with certain illustrated embodiments and practices. However, it will be clear to those skilled in the an that various modifications, additions and subtractions can be made without departing from the spirit or scope of the claims.

BRIEF DESCRIPTION OF THE DRAWINGS

For a fuller understanding of the nature and objects of the invention, reference should be made to the following detailed description and accompanying drawings, in which.

DETAILED DESCRIPTION OF THE INVENTION

Figure 1:
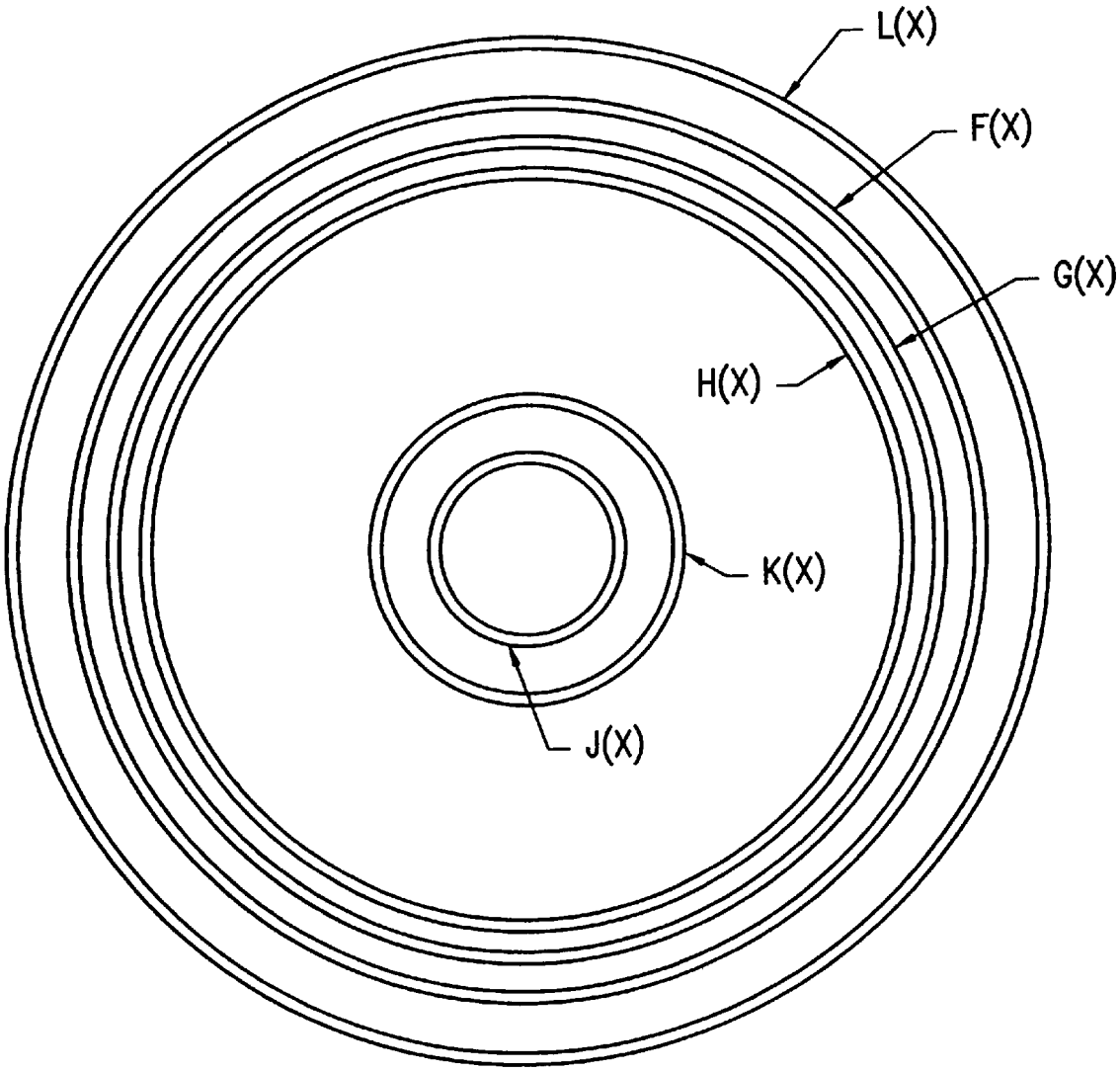
FIG. 1 is a plan view of a muffler in accordance with the present invention.
Figure 2:
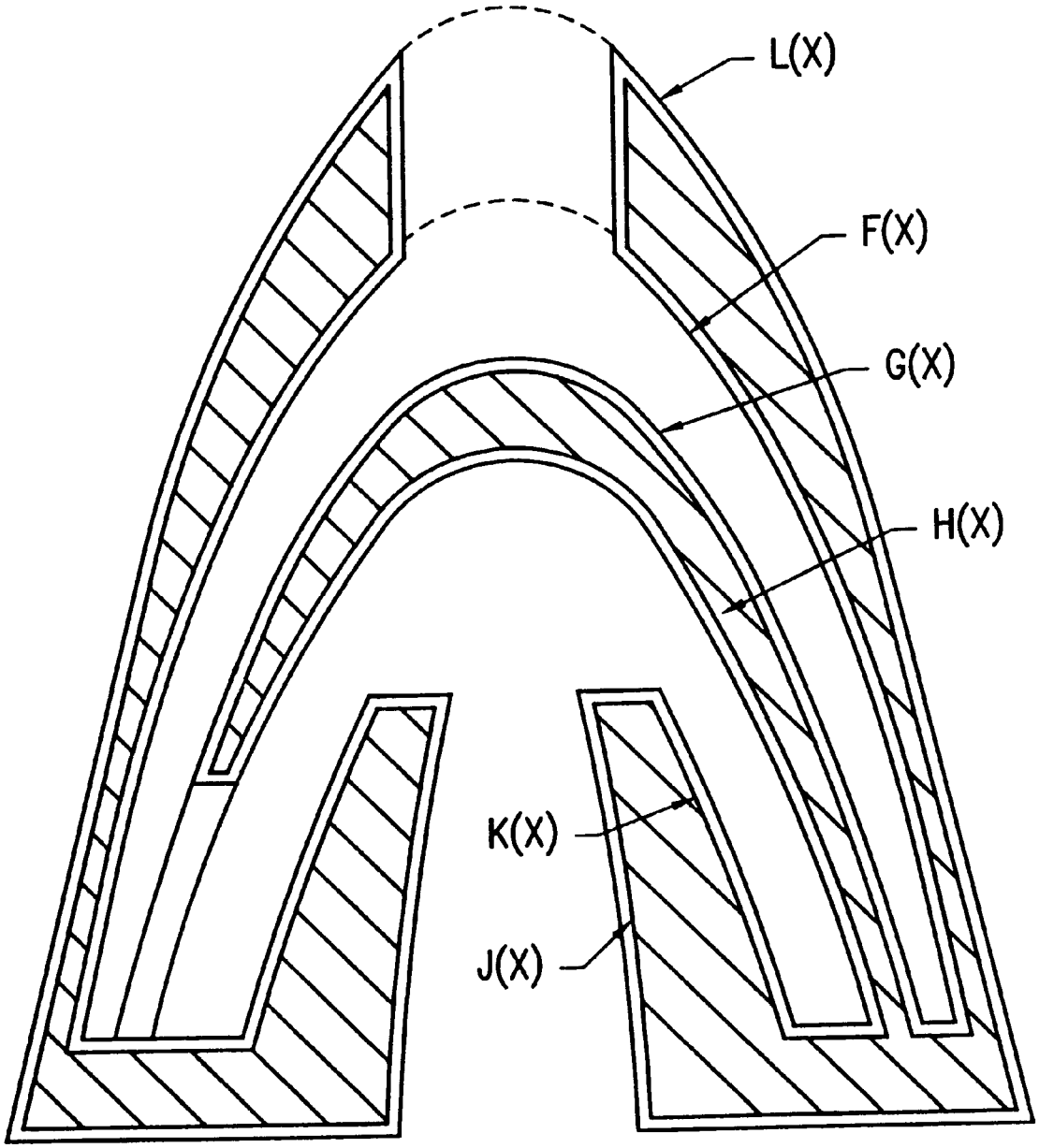
FIG. 2 is a section view of the muffler illustrated in FIG. 1 sectioned along a principal axis of the parabolic dome.
Figure 3:
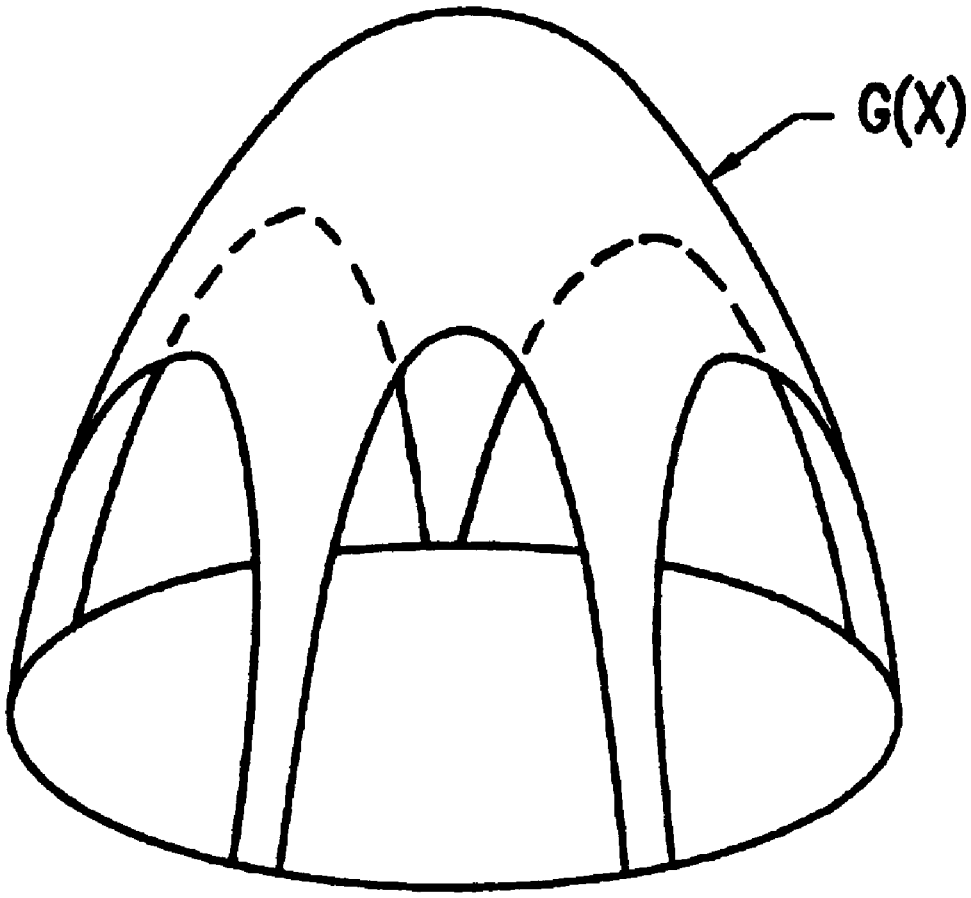
FIG. 3 is a perspective view of an interior dome portion of the muffler illustrated in FIG. 1.

The muffler depicted in FIGS. 1–3 employs a generally parabolic shape and vacuum chambers located in the path of sound entering the muffler to increase the path a sound wave must travel before exiting the muffler.

A vacuum does not contain molecules. Sound requires a medium, which has molecules, in order to be propagated. Therefore, sound does not travel through a vacuum. It is thus possible to insulate sound (or noise) by employing a vacuum. In the case of the present invention, a vacuum can be used to reduce noise (by increasing reflection) emanating from the exhaust of engines (or the source of noise), thus increasing the length if the path the sound must travel before exiting the muffler.

The function of the parabolic shape is in its properties of reflection of sound waves. (A shape other than a parabola could be used such as: a hyperbola, hemisphere, ellipse or any other shape which provides similar reflective properties). Waves traveling through the focus of a parabola are reflected generally parallel to its principle axis. In this manner, the paths of waves traveling through the focus of H(x) will be maximized. This action is facilitated by sound waves being "funneled" to the focus of H(x). This is made possible since the vertex of the primary parabolic chamber of J(x) is designated at the same location as the focus of H(x).

FIG. 1 shows a circular base of a muffler of which a section view can be rotated around its center to create a three-dimensional paraboloid. Those skilled in the art will recognize that while a circular shape is illustrated, it could also be hexagonal, octagonal or the like.

All parabolas are labeled. The vacuum can be contained in the space between J(x) and K(x), G(x) and H(x), and F(x) and L(x). Noise and air flow through the space between K(x) and H(x) as well as G(x) and F(x). The exhaust from the engine is located at the center, inside of the circle contained by J(x). This opening can be adjusted to fit the size of a specific exhaust pipe. The muffler could be fixed to the exhaust with the use of a threaded coupling or in some other conventional or unconventional manner. This may vary with the specific engine or machine.

FIG. 2 is a section view of the dome muffler. The vacuum can be contained in the striped region (either all or part thereof). The open arches in the interior dome, more clearly illustrated by FIG. 3, serve as passage for the air to flow through the muffler. Those skilled in the art will recognize that the size and number of the open arches may be varied to vary the performance of the muffler. As is illustrated, the space between G(x) and H(x) can alternate between air (under the arches) and vacuum (if contained in chamber). It is preferable for G(x) and H(x) to be lower than the height of J(x) and K(x), so that most of the sound waves will be deflected before leaving the muffler. In place of the arches, a series of holes, slits, or other opening could be shaped to allow air to flow through the space between G(x) and H(x).

It is also possible, but not necessary, to add additional materials for deflection of sound waves, specifically the waves entering the space between F(x) and G(x). Material could also be added to reduce resonance, echoing, impedance, whistling, constructive interference, and other unwanted side effects. Echoing is not likely, since the source must be 17 meters from the observer in order for a sound to echo. It might also be helpful to add material to aid in air flow and increase efficiency of the machine.

In general, low frequency sound waves are reflected by harder materials because they vibrate less freely and therefore do not absorb the energy of the sound waves. In contrast, softer materials tend to absorb low frequency sounds. A material, such as stainless steel, would be good to contain the vacuum (although other materials may be employed), because it reflects more low frequency sound waves, which tend to last in intensity over a longer distance than high frequency sounds. Stainless steel also withstands weathering and heat. Steel is the suggested material for its malleability, durability, and economical benefits. It is likely that something in the order of 18 gauge steel would be best, although other gauges (larger or smaller) could be acceptable.

The present invention can be applied to small engine devices such as lawn mowers, leaf blowers, snowmobiles and the like. The invention can also be used to reduce noise emitted from vacuum cleaners, automobiles, motorcycles, boats, or larger machines, It will thus be seen that the invention efficiently attains the objects set forth above, among those made apparent from the preceding description.

In particular, the invention provides improved noise reduction from engines and motors.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween Having described the invention, what is claimed as new and secured by Letters Patent is:

1. A method of attenuating sound propagating from a noise source comprising:

propagating said sound through a parabolic dome shaped muffler having an entrance and an exit, wherein said sound is provided through said entrance, and wherein a path exists through said muffler from said entrance to said exit;

providing at least one barrier within said muffler between said entrance and said exit;

reflecting said sound off of said barrier to propagate said sound in a direction of said path.

2. The method of attenuating sound according to claim 1 wherein said barrier includes a vacuum filled chamber.

3. The method of attenuating sound according to claim 2 further comprising a plurality of barriers each at least two of which include a vacuum filled chamber.

4. The method of attenuating sound according to claim 1 wherein a plurality of paths exist between said entrance and said exit.

5. The method of attenuating sound according to claim 1 further comprising a plurality of paths between said entrance and said exit.

6. A muffler comprising:

a plurality of concentric parabolic dome shaped barriers coupled together, each having at least one port, each in communication with each other, wherein said plurality of barriers forms a plurality of chambers therebetween.

7. The muffler according to claim 6 wherein at least one of said chambers includes a vacuum.

8. The muffler according to claim 6 wherein at least one of said dome shaped barriers is substantially elliptical.

9. The muffler according to claim 6 wherein a plurality of said chambers are provided with a vacuum.

10. The muffler according to claim 6 wherein said dome shaped barriers are steel barriers.

11. A muffler comprising:

a plurality of concentric barrier means coupled together, each having a plurality of ports in communication with each other, wherein said plurality of barrier means form a plurality of chambers therebetween;

wherein at least one of said chambers contains a vacuum.

12. The muffler according to claim 11 wherein said barrier means are substantially parabolic shaped domes.

13. The muffler according to claim 11 wherein said barriers are substantially elliptical shaped domes.

14. The muffler according to claim 11 wherein a plurality of said chambers are provided with a vacuum.

* * * * *

UNITED STATES PATENT AND TRADEMARK OFFICE

CERTIFICATE OF CORRECTION

PATENT NO. : 6,098,745
DATED : August 8, 2000
INVENTOR(S) : Jonathan Zalben

It is certified that error appears in the above-identified patent and that said Letters Patent is hereby corrected as shown below:

Column 2,
Line 3, please replace "an" with -- art -- .
Line 33, please replace "if" with -- of --.

Detailed Description.
Please replace "opening" with -- openings --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*